US010493320B2

(12) United States Patent
Porwal

(10) Patent No.: US 10,493,320 B2
(45) Date of Patent: Dec. 3, 2019

(54) EXERCISE ASSEMBLY

(71) Applicant: Anant Porwal, Bellevue, WA (US)

(72) Inventor: Anant Porwal, Bellevue, WA (US)

( * ) Notice: Subject to any disclaimer, the term of this patent is extended or adjusted under 35 U.S.C. 154(b) by 197 days.

(21) Appl. No.: 15/654,069

(22) Filed: Jul. 19, 2017

(65) Prior Publication Data

US 2019/0022457 A1 Jan. 24, 2019

(51) Int. Cl.

| | |
|---|---|
| ***A63B 22/06*** | (2006.01) |
| ***A63B 69/16*** | (2006.01) |
| ***A63B 69/00*** | (2006.01) |
| ***A63B 21/00*** | (2006.01) |
| ***A63B 22/02*** | (2006.01) |
| ***A63B 71/06*** | (2006.01) |

(52) U.S. Cl.

CPC ..... *A63B 22/0605* (2013.01); *A63B 21/4009* (2015.10); *A63B 21/4015* (2015.10); *A63B 69/0064* (2013.01); *A63B 69/16* (2013.01); *A63B 22/02* (2013.01); *A63B 2022/0635* (2013.01); *A63B 2069/162* (2013.01); *A63B 2069/168* (2013.01); *A63B 2071/0658* (2013.01)

(58) Field of Classification Search

CPC ..... A63B 22/0605; A63B 22/02; A63B 2022/0635; A63B 21/4015; A63B 21/4009; A63B 69/0064; A63B 69/16; A63B 2069/168; A63B 2071/0658; A63B 2069/162

See application file for complete search history.

(56) References Cited

U.S. PATENT DOCUMENTS

| | | | | |
|---|---|---|---|---|
| 4,082,265 | A | 4/1978 | Berkes | |
| 4,415,152 | A | 11/1983 | Smith | |
| 4,925,183 | A * | 5/1990 | Kim | A63B 22/16 434/61 |
| D311,884 | S | 11/1990 | Kagayama | |
| 6,945,917 | B1 * | 9/2005 | Baatz | A63B 21/0051 482/57 |
| 7,037,241 | B2 | 5/2006 | Kuo | |
| 7,736,282 | B1 * | 6/2010 | Horowitz | A63B 69/16 482/57 |
| 9,227,102 | B2 | 1/2016 | Haddon et al. | |
| 2009/0124467 | A1 * | 5/2009 | Hildebrandt | A63B 21/154 482/62 |
| 2014/0066264 | A1 * | 3/2014 | Haddon | A63B 69/16 482/61 |
| 2015/0011364 | A1 * | 1/2015 | Kimura | A63B 69/16 482/57 |
| 2015/0065309 | A1 | 3/2015 | Bauer et al. | |
| 2015/0217158 | A1 * | 8/2015 | Colan | A63B 22/0605 482/61 |
| 2016/0023049 | A1 * | 1/2016 | Dalebout | A63B 22/0242 482/7 |

* cited by examiner

*Primary Examiner* — Sundhara M Ganesan

(57) ABSTRACT

An exercise assembly for physical therapy and rehabilitation includes a bicycle and a treadmill. The bicycle has a pair of front forks. The treadmill has a belt that is configured to rotate. A coupler is coupled to the treadmill. The coupler is configured to couple to the front forks. The coupler is positioned to reversibly couple to the front forks to couple the bicycle to the treadmill such that a rear wheel of the bicycle is positioned on the belt. The belt is positioned to rotate the rear wheel such that rotary motion is transferred through a pair of pedals of the bicycle to legs of a user who is positioned on the bicycle.

13 Claims, 8 Drawing Sheets

EXERCISE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to exercise assemblies and more particularly pertains to a new exercise assembly for physical therapy and rehabilitation.

BRIEF SUMMARY OF THE INVENTION

An embodiment of the disclosure meets the needs presented above by generally comprising a bicycle and a treadmill. The bicycle has a pair of front forks. The treadmill has a belt that is configured to rotate. A coupler is coupled to the treadmill. The coupler is configured to couple to the front forks. The coupler is positioned to reversibly couple to the front forks to couple the bicycle to the treadmill such that a rear wheel of the bicycle is positioned on the belt. The belt is positioned to rotate the rear wheel such that rotary motion is transferred through a pair of pedals of the bicycle to legs of a user who is positioned on the bicycle.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
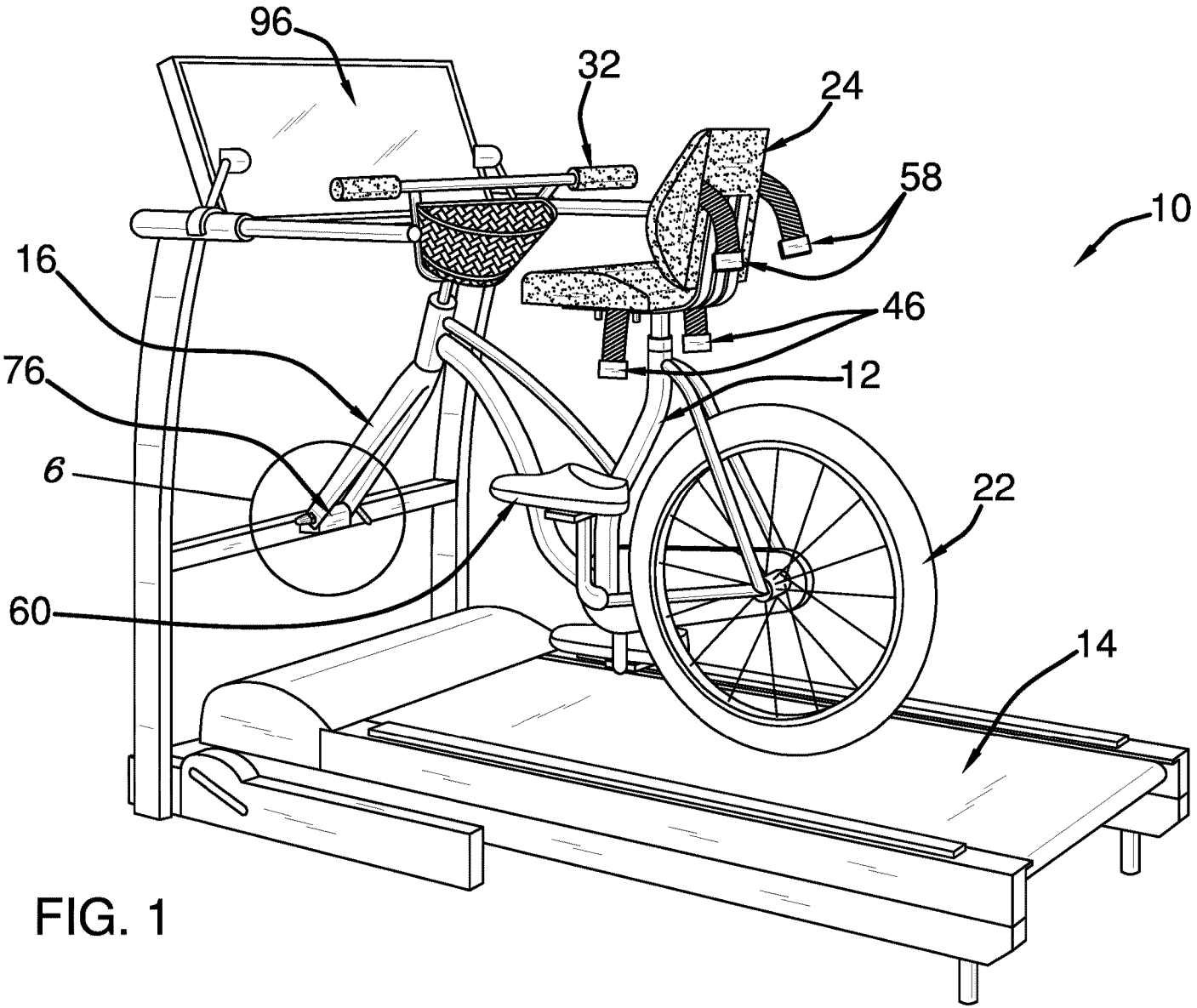
FIG. 1 is an isometric perspective view of an exercise assembly according to an embodiment of the disclosure.
Figure 2:
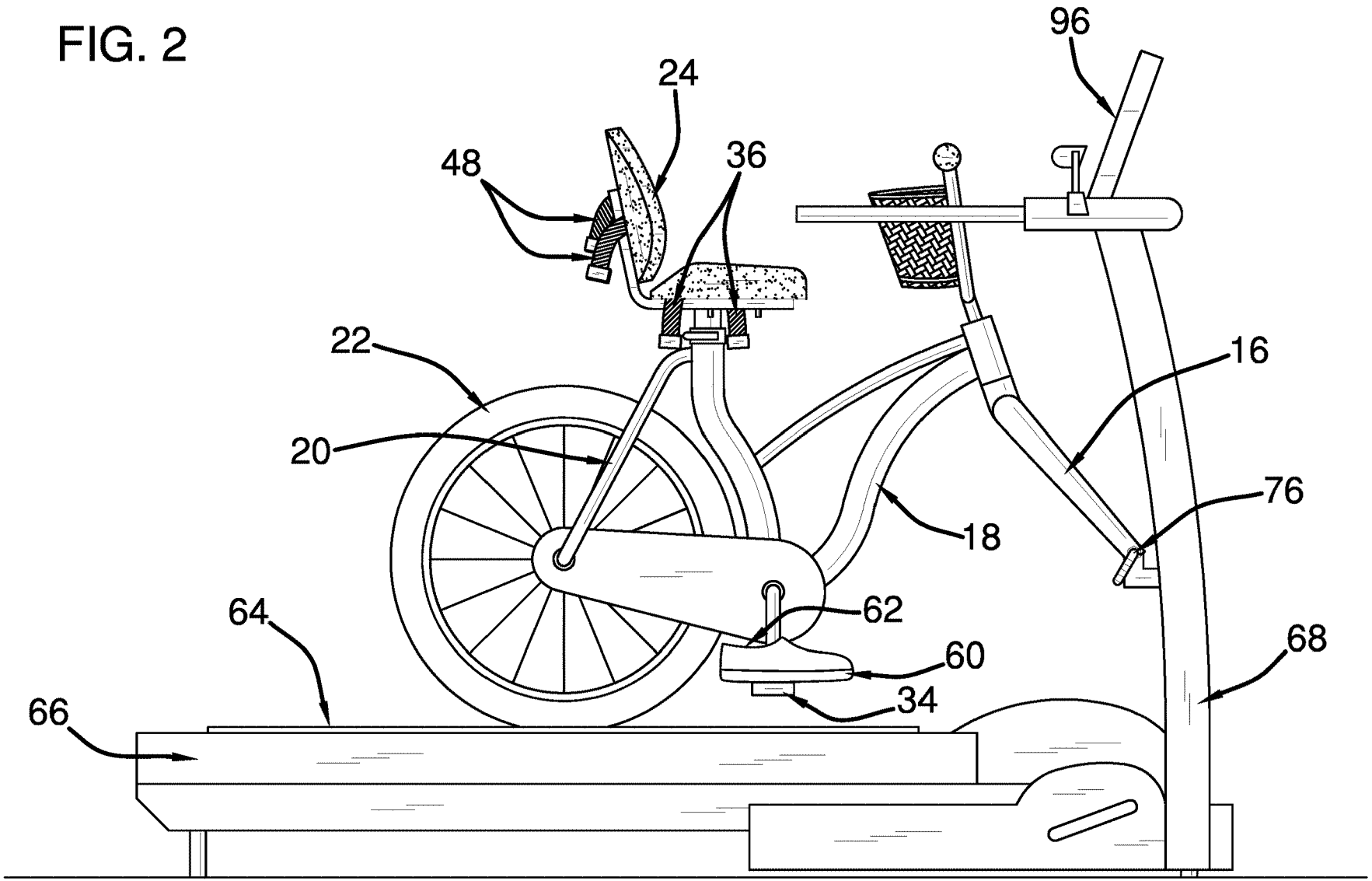
FIG. 2 is a side view of an embodiment of the disclosure.
Figure 3:
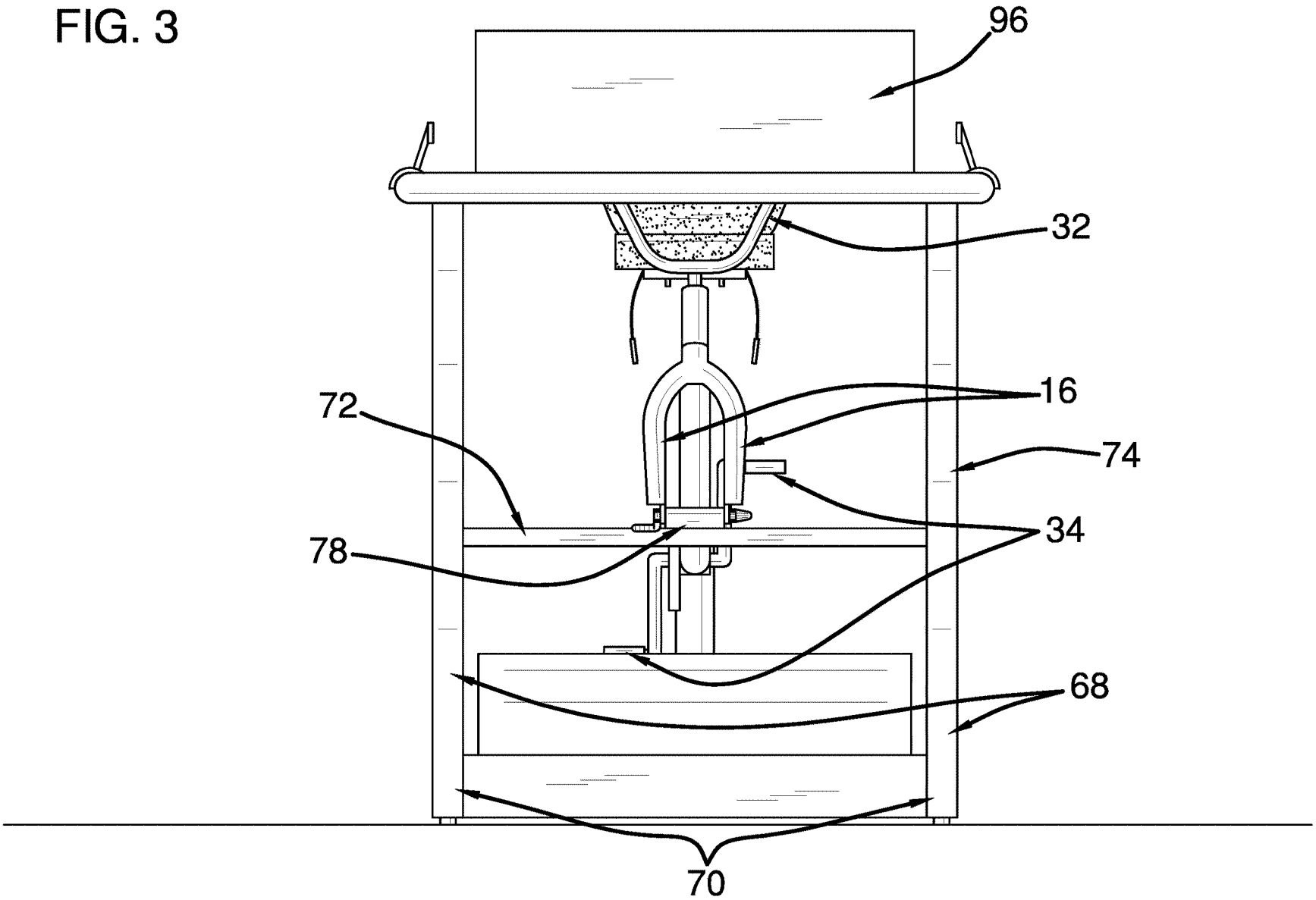
FIG. 3 is a front view of an embodiment of the disclosure.
Figure 4:
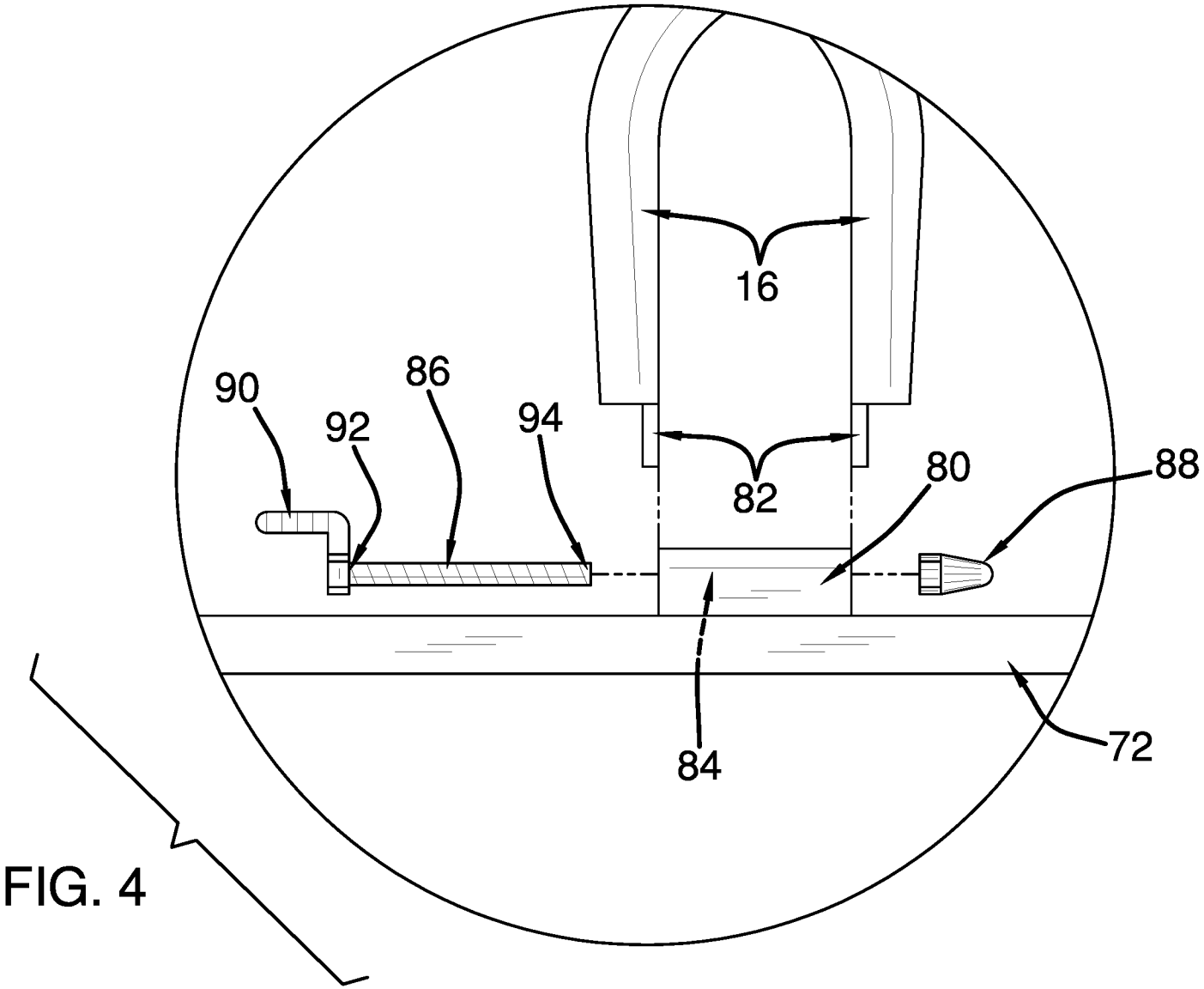
FIG. 4 is a detail view of an embodiment of the disclosure.
Figure 5:
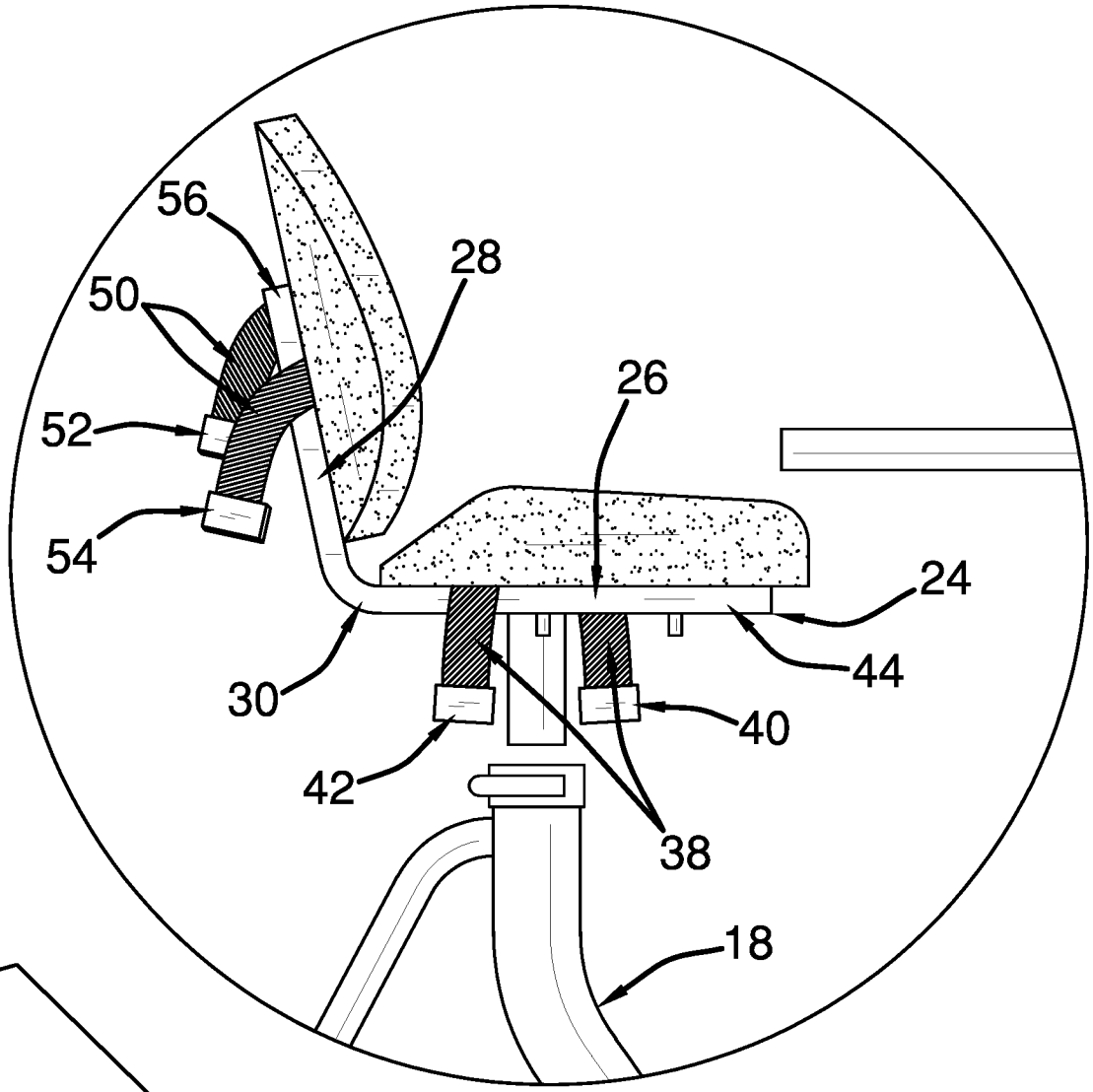
FIG. 5 is a detail view of an embodiment of the disclosure.
Figure 6:
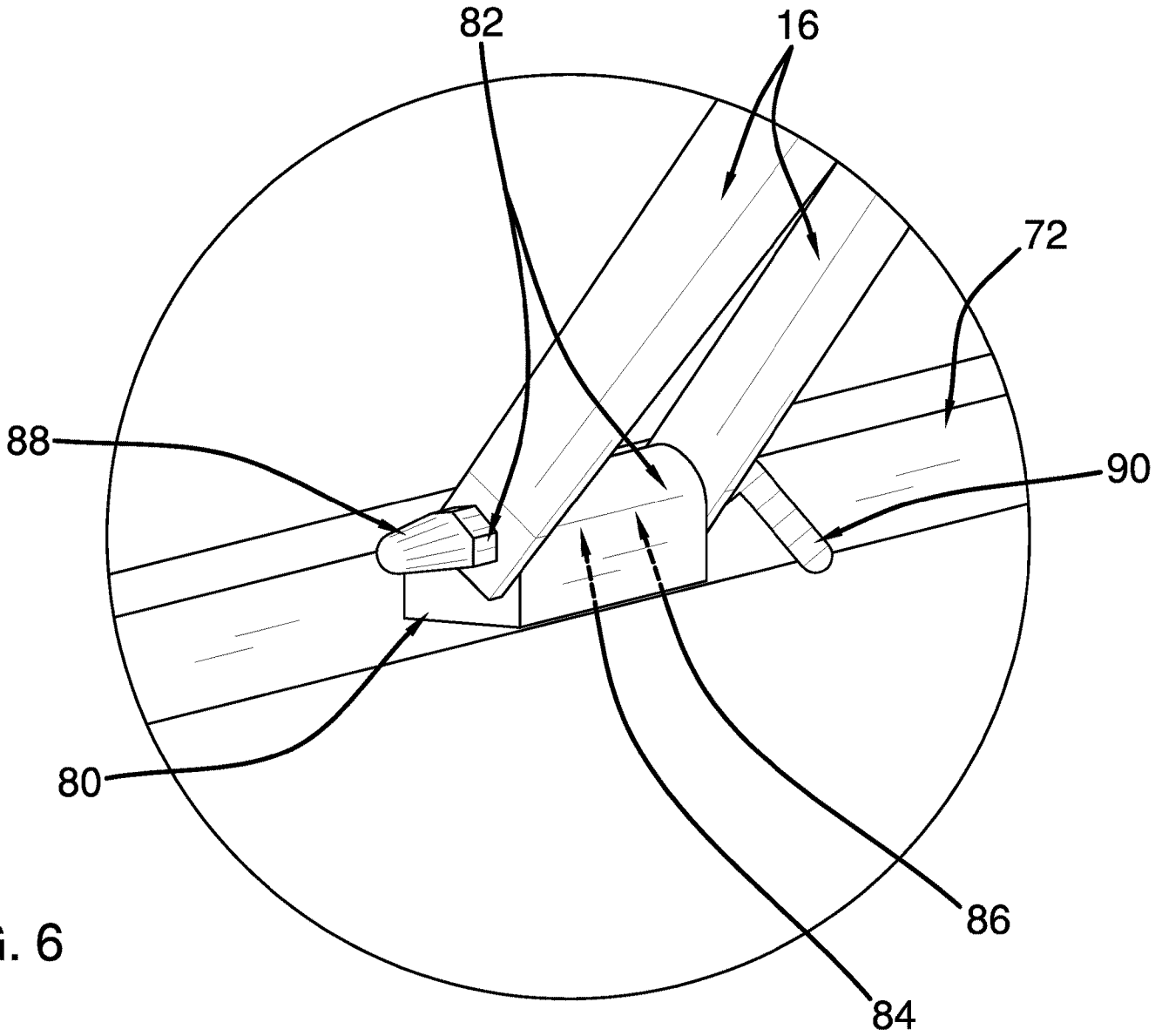
FIG. 6 is a detail view of an embodiment of the disclosure.

With reference now to the drawings, and in particular to FIGS. 1 through 8 thereof, a new exercise assembly embodying the principles and concepts of an embodiment of the disclosure and generally designated by the reference numerals 10 and 100 will be described.

As best illustrated in FIGS. 1 through 6, the exercise assembly 10 generally comprises a bicycle 12 and a treadmill 14. The bicycle 12 has a pair of front forks 16. The bicycle 12 comprises a frame 18 that is coupled to the front forks 16. A pair of rear forks 20 is coupled to and extends from the frame 18. A rear wheel 22 is axially coupled to the rear forks 20. A seat 24 is coupled to and extends from the frame 18. The seat 24 is configured to seat a user. In one embodiment, the seat 24 comprises a first plate 26 and a second plate 28. The first plate 26 is coupled to the frame 18. The second plate 28 is coupled to and extends transversely from a rear edge 30 of the first plate 26. In another embodiment, the first plate 26 and the second plate 28 are padded.

A handlebar 32 is coupled to and extends from the frame 18. The handlebar 32 is configured to position hands of the user. A pair of pedals 34 is coupled to and extends from the frame 18. The pedals 34 are operationally coupled to the rear wheel 22 using a direct gearing connection such that movement of the rear wheel 22 translates to movement of the pedals 34 and vice versa. Unlike conventional connections utilized in which a wheel may be allowed to spin while the pedals remain stationary, commonly referred to as coasting while riding a conventional bike. The pedals 34 are positioned on the frame 18 such that each pedal 34 is configured to position a respective foot of the user.

A first restraint 36 is coupled to the first plate 26. The first restraint 36 is configured to couple the user to the first plate 26. In one embodiment, the first restraint 36 comprises a pair of first straps 38, a first connector 40, and a second connector 42. Each first strap 38 is coupled to and extends from a respective opposing side 44 of the first plate 26. The pair of first straps 38 is configured to position across a lap of the user. The first connector 40 and the second connector 42 are coupled singly to the first straps 38 distal from the first plate 26. The second connector 42 is complementary to the first connector 40. The second connector 42 is positioned on a respective first strap 38 so that second connector 42 is positioned to couple to the first connector 40 to couple the user to the first plate 26. In another embodiment, the first connector 40 and the second connector 42 comprise a first side release buckle 46.

A second restraint 48 is coupled to the second plate 28. The second restraint 48 is configured to couple the user to the second plate 28. In one embodiment, the second restraint 48 comprises a pair of second straps 50, a first fastener 52, and a second fastener 54. Each second strap 50 is coupled to and extends from a respective opposing edge 56 of the second plate 28. The pair of second straps 50 is configured to position around a torso of the user near a waist of the user. The first fastener 52 and the second fastener 54 are coupled singly to the second straps 50 distal from the second plate 28. The second fastener 54 is complementary to the first fastener 52. The second fastener 54 is positioned on a respective second strap 50 so that the second fastener 54 is positioned to couple to the first fastener 52 to couple the user to the second plate 28. In another embodiment, the first fastener 52 and the second fastener 54 comprise a second side release buckle 58.

A pair of shells 60 is coupled singly to the pair of pedals 34. Each shell 60 is substantially complementary to a respective foot of the user. Each of a pair of openings 62 is positioned in a respective shell 60. The shells 60 are configured to insert the feet of the user so that the feet are coupled to the pedals 34. The shells 60 may be adjustable in a conventional manner to snuggly fit.

The treadmill 14 has a belt 64 that is configured to rotate. The treadmill 14 comprises a platform 66 that houses the belt 64. Each of a pair of columns 68 is coupled proximate to a respective front corner 70 of the platform 66. The columns 68 extend substantially vertically from the platform 66. A crossbeam 72 is coupled to and extends between the columns 68. The crossbeam 72 is positioned proximate to a midpoint 74 of each column 68. The crossbeam 72 may also be located at any point between each column 68 providing proper level orientation of the bicycle 12 on the treadmill 14.

A coupler 76 is coupled to the treadmill 14. The coupler 76 is configured to couple to the front forks 16. The coupler 76 is positioned to reversibly couple to the front forks 16 to couple the bicycle 12 to the treadmill 14. The rear wheel 22 of the bicycle 12 is positioned on the belt 64. The belt 64 is positioned to rotate the rear wheel 22 such that rotary motion is transferred through the pair of pedals 34 of the bicycle 12 to legs of the user who is positioned on the bicycle 12.

In one embodiment, the coupler 76 comprises a quick-release wheel connector 78. In another embodiment, the coupler 76 comprises a bracket 80 that is coupled to and extends from the crossbeam 72. The bracket 80 is positioned substantially equally distant from the columns 68. The bracket 80 is L-shaped when viewed longitudinally. The bracket 80 is positioned to insert between a pair of dropouts 82 that is positioned singly in the pair of front forks 16. A channel 84 is positioned longitudinally through the bracket 80 distal from the crossbeam 72. The channel 84 is alignable with the pair of dropouts 82. The coupler 76 also comprises a bolt 86, a cap 88, and a lever 90. The bolt 86 is substantially complementary to the channel 84. The cap 88 is threaded and is complementary to the bolt 86. The lever 90 is coupled to a first end 92 of the bolt 86. The lever 90 is quick-release styled. The channel 84 is positioned to insert the bolt 86 so that the bolt 86 is positioned through the channel 84 and the pair of dropouts 82. A second end 94 of the bolt 86 is positioned to couple to the cap 88. The lever 90 is configured to be motivated to a closed position to clampedly couple the front forks 16 to the bracket 80. The bicycle 12 is coupled to the treadmill 14.

A screen 96 is coupled to and extends between the columns 68 distal from the platform 66. The screen 96 is configured to display visual content to the user who is positioned on the bicycle 12.

In use, the bracket 80 positioned to insert between the pair of dropouts 82. The channel 84 is positioned to insert the bolt 86 so that the bolt 86 is positioned through the channel 84 and the pair of dropouts 82. The second end 94 of the bolt 86 is positioned to couple to the cap 88. The lever 90 is configured to be motivated to the closed position to clampedly couple the front forks 16 to the bracket 80. The bicycle 12 is coupled to the treadmill 14. The seat 24 that is positioned on the frame 18 is configured to seat the user. The pair of first straps 38 is configured to position across the lap of the user. The second connector 42 is positioned to couple to the first connector 40 to couple the user to the first plate 26. The pair of second straps 50 is configured to position around the torso of the user near the waist. The second fastener 54 is positioned to couple to the first fastener 52 to couple the user to the second plate 28. The handlebar 32 that is positioned on the frame 18 is configured to position the hands of the user. The openings 62 are positioned in the shells 60 so that the shells 60 are configured to insert the feet of the user. The feet are coupled to the pedals 34. The rear wheel 22 of the bicycle 12 is positioned on the belt 64. The belt 64 is positioned to rotate the rear wheel 22. The rotary motion is transferred through the pair of pedals 34 of the bicycle 12 to the legs of the user who is positioned on the bicycle 12. The screen 96 is configured to display the visual content to the user who is positioned on the bicycle 12.

Figure 7:
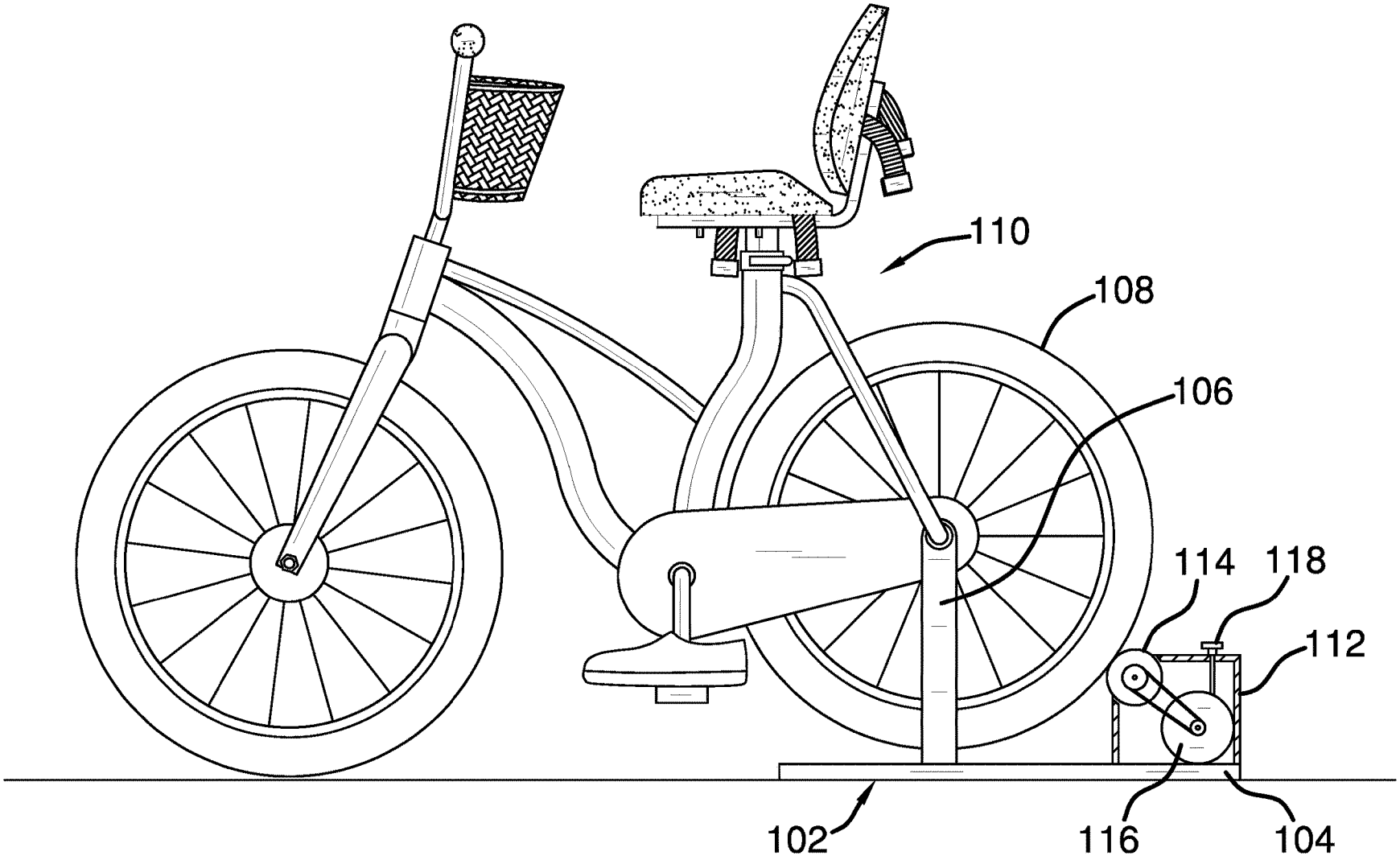
FIG. 7 is a partial cut-away side view of an alternative embodiment of the disclosure.
Figure 8:
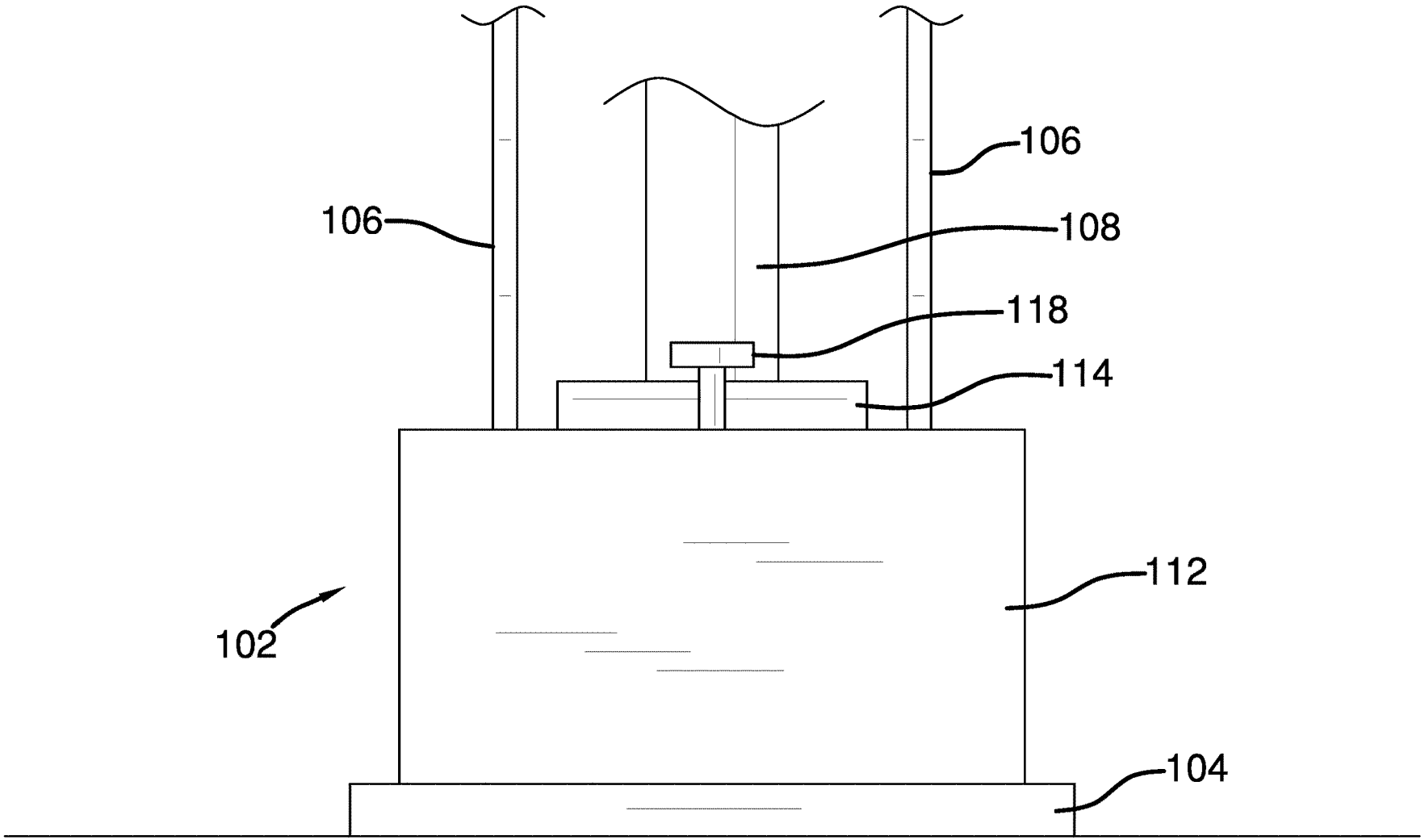
FIG. 8 is a partial rear view of the alternative embodiment of the disclosure.

In an alternative embodiment as shown in FIGS. 7 and 8, the exercise assembly 100 includes a stand 102 having a base 104 and a pair of uprights 106. A rear wheel 108 of a conventional bicycle 110 is supported on the stand 102 such that the rear wheel 108 is elevated and rotation of the rear wheel 108 will not urge the bicycle 110 to move. A housing 112 is coupled to the stand 102. A drive gear 114 is coupled to the housing 112 and exposed through the housing 112. The drive gear 114 is rotated by a motor 116 positioned within the housing 112. The housing 112 is positioned spaced from the uprights 106 such that the rear wheel 108 contacts the drive gear 114 imparting rotation to the rear wheel 108. The rear wheel 108 is again in connection with pedals in a manner which both move simultaneously as opposed to allowing coasting to occur. A speed control 118 is coupled to the housing 112 and operationally coupled to the motor 116 to adjust the speed of rotation imparted to the rear wheel 108. The alternative embodiment shown in FIGS. 7 and 8 operates in the same manner as the embodiment shown in FIGS. 1 through 6 with mechanical impartation of rotation to the rear wheels 22, 108 and allowing the user to exercise on a stationary bicycle 12, 110.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An exercise assembly comprising:

a bicycle, said bicycle being supported such that said bicycle remains stationary when a rear wheel of said bicycle is rotated, said bicycle comprising a pair of front forks, a frame coupled to said front forks, a pair of rear forks coupled to and extending from said frame, said rear wheel being axially coupled to said rear forks, a seat coupled to and extending from said frame, a handlebar coupled to and extending from said frame, said pair of pedals being coupled to and extending from said frame, said pedals being operationally coupled to said rear wheel, and wherein said seat is positioned on said frame such that said seat is configured for seating a user, wherein said handlebar is positioned on said frame such that said handlebar is configured for positioning hands of the user, wherein said pedals are positioned on said frame such that each said pedal is configured for positioning a respective foot of the user;

a device imparting rotation to said rear wheel of said bicycle, said device being incorporated into support of said bicycle such that said bicycle remains stationary while said rear wheel rotates, said device comprising a treadmill, said treadmill comprising a belt, said belt being configured for rotating, a platform housing said belt, a pair of columns, each said column being coupled proximate to a respective front corner of said platform, said columns extending substantially vertically from said platform, and a crossbeam coupled to and extending between said columns, said crossbeam being positioned proximate to a midpoint of each said column;

wherein said rear wheel is operationally coupled to a pair of pedals of said bicycle such that rotary motion of said rear wheel is transferred to said pair of pedals of said bicycle;

a coupler coupled to said treadmill, said coupler being configured for coupling to said front forks;

a screen coupled to and extending between said columns distal from said platform, wherein said screen is positioned on said columns such that said screen is configured for displaying visual content to the user positioned on said bicycle; and wherein said coupler is positioned on said treadmill such that said coupler is positioned for reversibly coupling to said front forks for coupling said bicycle to said treadmill such that said rear wheel of said bicycle is positioned on said belt to rotate said rear wheel.

2. The assembly of claim 1, further including said seat comprising a first plate and a second plate, said first plate being coupled to said frame, said second plate being coupled to and extending transversely from a rear edge of said first plate.

3. The assembly of claim 2, further including said first plate and said second plate being padded.

4. The assembly of claim 2, further including a first restraint coupled to said first plate, said first restraint being configured for coupling the user to said first plate.

5. The assembly of claim 4, further including said first restraint comprising a pair of first straps, a first connector, and a second connector, each said first strap being coupled to and extending from a respective opposing side of said first plate such that said pair of first straps is configured for positioning across a lap of the user, said first connector and said second connector being coupled singly to said first straps distal from said first plate, said second connector being complementary to said first connector, wherein said second connector is positioned on a respective said first strap such that said second connector is positioned for coupling to said first connector for coupling the user to said first plate.

6. The assembly of claim 5, further including said first connector and said second connector comprising a first side release buckle.

7. The assembly of claim 2, further including a second restraint coupled to said second plate, said second restraint being configured for coupling the user to said second plate.

8. The assembly of claim 7, further including said second restraint comprising a pair of second straps, a first fastener, and a second fastener, each said second strap being coupled to and extending from a respective opposing edge of said second plate such that said pair of second straps is configured for positioning around a torso of the user, said first fastener and said second fastener being coupled singly to said second straps distal from said second plate, said second fastener being complementary to said first fastener, wherein said second fastener is positioned on a respective said second strap such that said second fastener is positioned for coupling to said first fastener for coupling the user to said second plate.

9. The assembly of claim 8, further including said first fastener and said second fastener comprising a second side release buckle.

10. The assembly of claim 1, further comprising:

a pair of shells coupled singly to said pair of pedals, each said shell being substantially complementary to a respective foot of the user;

a pair of openings, each said opening being positioned in a respective said shell; and wherein said openings are positioned in said shells such that said shells are configured for inserting the feet of the user such that the feet are coupled to said pedals.

11. The assembly of claim 1, further including said coupler comprising a quick-release wheel connector.

12. The assembly of claim 1, further including said coupler comprising:

a bracket coupled to and extending from said crossbeam, said bracket being positioned substantially equally distant from said columns, said bracket being L-shaped when viewed longitudinally, wherein said bracket is positioned on said crossbeam such that said bracket is positioned for inserting between a pair of dropouts positioned singly in said pair of front forks;

a channel positioned longitudinally through said bracket distal from said crossbeam, said channel being alignable with said pair of dropouts;

a bolt substantially complementary to said channel;

a cap, said cap being threaded, said cap being complementary to said bolt, a lever coupled to a first end of said bolt, said lever being quick-release styled; and wherein said channel is positioned through said bracket such that said channel is positioned for inserting said bolt such that said bolt is positioned through said channel and said pair of dropouts, wherein a second end of said bolt is positioned for coupling to said cap, wherein said lever is configured for motivating to a closed positioned for clampedly coupling said front forks to said bracket such that said bicycle is coupled to said treadmill.

13. An exercise assembly comprising:

a bicycle, said bicycle comprising:

a pair of front forks, a frame coupled to said front forks, a pair of rear forks coupled to and extending from said frame;

a pair of pedals coupled to said frame, said pedals being positioned on said frame such that each said pedal is configured for positioning a respective foot of the user, a rear wheel axially coupled to said rear forks, rear wheel being operationally coupled to said pair of pedals such that rotary motion of said rear wheel is transferred to said pair of pedals, a seat coupled to and extending from said frame, wherein said seat is positioned on said frame such that said seat is configured for seating a user, said seat comprising a first plate and a second plate, said first plate being coupled to said frame, said second plate being coupled to and extending transversely from a rear edge of said first plate, said first plate and said second plate being padded, and a handlebar coupled to and extending from said frame, wherein said handlebar is positioned on said frame such that said handlebar is configured for positioning hands of the user;

a first restraint coupled to said first plate, said first restraint being configured for coupling the user to said first plate, said first restraint comprising a pair of first straps, a first connector, and a second connector, each said first strap being coupled to and extending from a respective opposing side of said first plate such that said pair of first straps is configured for positioning across a lap of the user, said first connector and said second connector being coupled singly to said first straps distal from said first plate, said second connector being complementary to said first connector, wherein said second connector is positioned on a respective said first strap such that said second connector is positioned for coupling to said first connector for coupling the user to said first plate, said first connector and said second connector comprising a first side release buckle;

a second restraint coupled to said second plate, said second restraint being configured for coupling the user to said second plate, said second restraint comprising a pair of second straps, a first fastener, and a second fastener, each said second strap being coupled to and extending from a respective opposing edge of said second plate such that said pair of second straps is configured for positioning around a chest of the user, said first fastener and said second fastener being coupled singly to said second straps distal from said second plate, said second fastener being complementary to said first fastener, wherein said second fastener is positioned on a respective said second strap such that said second fastener is positioned for coupling to said first fastener for coupling the user to said second plate, said first fastener and said second fastener comprising a second side release buckle;

a pair of shells coupled singly to said pair of pedals, each said shell being substantially complementary to a respective foot of the user;

a pair of openings, each said opening being positioned in a respective said shell, wherein said openings are positioned in said shells such that said shells are configured for inserting the feet of the user such that the feet are coupled to said pedals;

a treadmill having a belt, said belt being configured for rotating, said treadmill comprising:

a platform housing said belt, a pair of columns, each said column being coupled proximate to a respective front corner of said platform, said columns extending substantially vertically from said platform, and a crossbeam coupled to and extending between said columns, said crossbeam being positioned proximate to a midpoint of each said column;

a coupler coupled to said treadmill, said coupler being configured for coupling to said front forks, wherein said coupler is positioned on said treadmill such that said coupler is positioned for reversibly coupling to said front forks for coupling said bicycle to said treadmill such that said rear wheel of said bicycle is positioned on said belt, wherein said belt is positioned for rotating said rear wheel such that rotary motion is transferred through said pair of pedals of said bicycle to legs of the user positioned on said bicycle, said coupler comprising a quick-release wheel connector, said coupler comprising:

a bracket coupled to and extending from said crossbeam, said bracket being positioned substantially equally distant from said columns, said bracket being L-shaped when viewed longitudinally, wherein said bracket is positioned on said crossbeam such that said bracket is positioned for inserting between a pair of dropouts positioned singly in said pair of front forks, a channel positioned longitudinally through said bracket distal from said crossbeam, said channel being alignable with said pair of dropouts, a bolt substantially complementary to said channel, a cap, said cap being threaded, said cap being complementary to said bolt, and a lever coupled to a first end of said bolt, said lever being quick-release styled, wherein said channel is positioned through said bracket such that said channel is positioned for inserting said bolt such that said bolt is positioned through said channel and said pair of dropouts, wherein a second end of said bolt is positioned for coupling to said cap, wherein said lever is configured for motivating to a closed positioned for clampedly coupling said front forks to said bracket such that said bicycle is coupled to said treadmill;

a screen coupled to and extending between said columns distal from said platform, wherein said screen is positioned on said columns such that said screen is configured for displaying visual content to the user positioned on said bicycle; and wherein said bracket is positioned on said crossbeam such that said bracket is positioned for inserting between said pair of dropouts, wherein said channel is positioned through said bracket such that said channel is positioned for inserting said bolt such that said bolt is positioned through said channel and said pair of dropouts, wherein said second end of said bolt is positioned for coupling to said cap, wherein said lever is configured for motivating to the closed positioned for clampedly coupling said front forks to said bracket such that said bicycle is coupled to said treadmill, wherein said seat is positioned on said frame such that said seat is configured for seating a user, wherein said pair of first straps is configured for positioning across a lap of the user such that said second connector is positioned for coupling to said first connector for coupling the user to said first plate, wherein said pair of second straps is configured for positioning around a chest of the user such that said second fastener is positioned for coupling to said first fastener for coupling the user to said second plate, wherein said handlebar is positioned on said frame such that said handlebar is configured for positioning hands of the user, wherein said openings are positioned in said shells such that said shells are configured for inserting the feet of the user such that the feet are coupled to said pedals, wherein said rear wheel of said bicycle is positioned on said belt such that said belt is positioned for rotating said rear wheel such that the rotary motion is transferred through said pair of pedals of said bicycle to the legs of the user positioned on said bicycle.

* * * * *